United States Patent [19]

Rayman

[11] 4,035,632

[45] July 12, 1977

[54] FIXTURE SYSTEM

[76] Inventor: Robert R. Rayman, 922 Courtney Road, Baltimore, Md. 21227

[21] Appl. No.: 572,725

[22] Filed: Apr. 29, 1975

[51] Int. Cl.[2] ..... H05B 33/02; E05B 17/00

[52] U.S. Cl. ..... 240/51.11 R; 240/2 R; 240/2.13

[58] Field of Search ..... 240/51.11 R, 2 R, 2.13, 240/104; 52/28

[56] References Cited

U.S. PATENT DOCUMENTS

| | | | |
|---|---|---|---|
| 2,844,306 | 7/1958 | Broadwin | 240/2 R |
| 3,063,496 | 11/1962 | Kessler | 52/28 |

FOREIGN PATENT DOCUMENTS

| | | | |
|---|---|---|---|
| 1,521,503 | 3/1968 | France | 240/51.11 R |

*Primary Examiner*—Stephen J. Tomsky
*Attorney, Agent, or Firm*—Morton J. Rosenberg

[57] ABSTRACT

A light fixture system to be used for identification purposes as well as for security. The system includes a housing having an internal chamber which is adapted to be mounted to the external wall of an edifice. A translucent first window member covers an opening formed through a frontal portion of the housing. A second, substantially transparent, window member located below and to the rear of the first window provides illumination of a name plate and is used to provide illumination over a wide external area for security purposes. The first window member includes indicia formed thereon for purposes of identification. Specific contouring of the overall shape of the housing provides for an aid in water proofing the internal structure of the lighting system. A fluorescent or generally gas vapor type lamp is contained within the housing chamber to provide illumination through the first and second window members mounted on the housing periphery.

18 Claims, 3 Drawing Figures

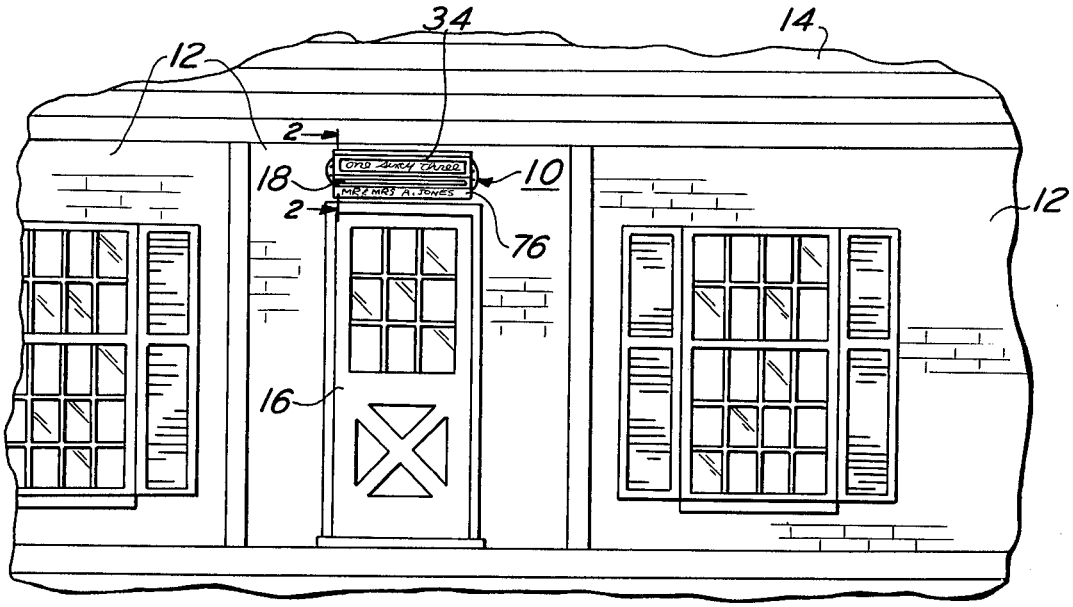
FIG. 1
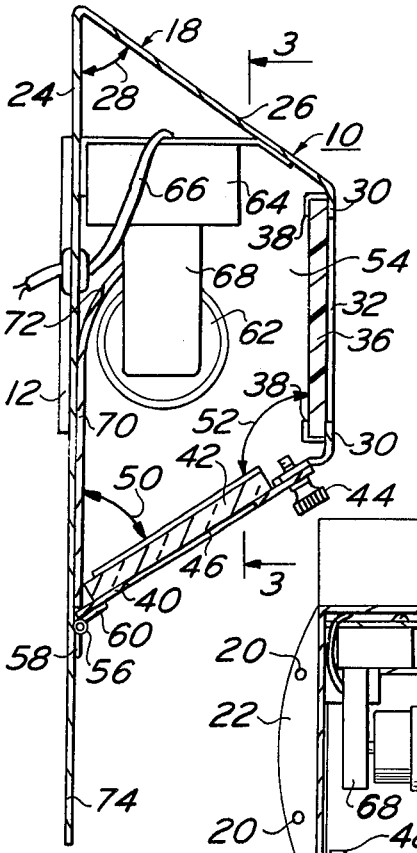
FIG. 2
FIG. 3
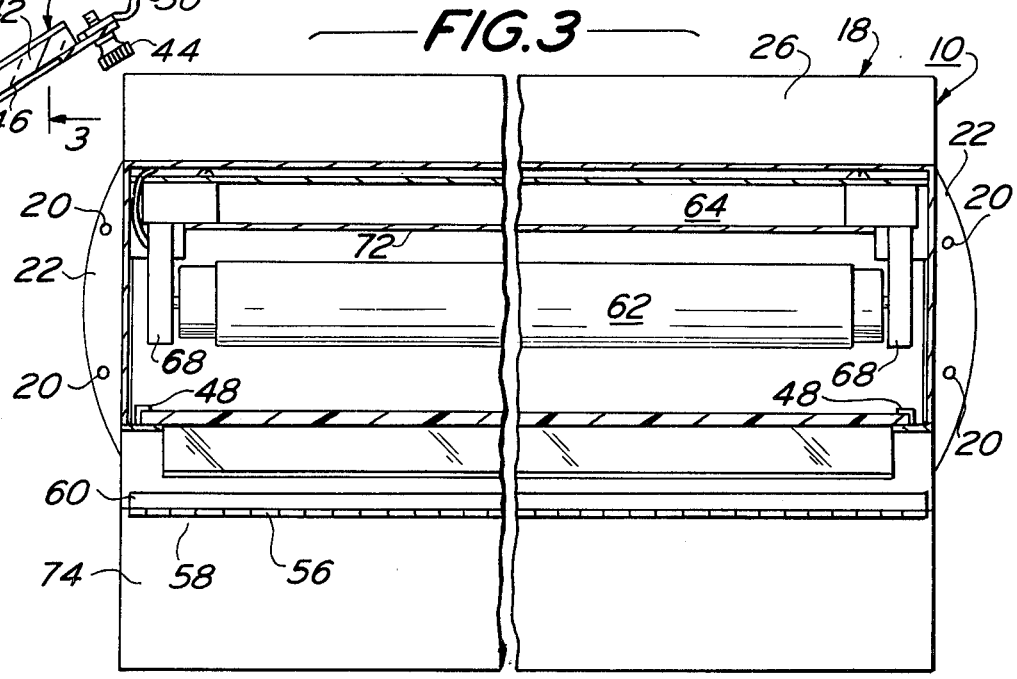

FIXTURE SYSTEM

BACKGROUND OF THE INVENTION

1. Field of the Invention

This invention pertains to light fixture systems. Further, this invention relates to light fixture systems adapted to be used for identification and security purposes. Still further, this invention pertains to light fixture systems having a structural contour which aids in providing an independent environment of the internal workings of the system when taken with respect to the external environment. Additionally, this invention relates to systems which may be mounted on an external surface of an edifice for purposes of identifying the edifice. This invention pertains to a light fixture system structure which provides a means for incorporating a name plate and illumination of the name plate in one general structural configuration. More particularly, this invention pertains to a light fixture system utilizing a gas vapor or fluorscent lamp to provide an inexpensively operating light system.

2. Prior Art

Lighting fixture systems utilized for security purposes are known in the art. However, generally in some prior cases such light fixtures included flood lights. Utilization of such system was expensive to maintain and generally was not esthetic for use on domestic edifices.

In some prior light fixture systems used for security purposes, filament type lamps were utilized which lead to increased operating costs. In some cases this had the effect of the user only utilizing such prior light fixture systems for intermittent operating periods.

In other prior light fixture systems utilized external to an edifice, additional structure had to be generally added to aid in water proofing. Such prior systems did not include specific contouring of the light fixture to minimize liquid leakage internal to the systems with the resulting effect that in some cases the illuminating mechanism contained within the light fixtures systems was damaged.

In some prior light fixture systems, optimum use of the contouring of the systems were not utilized to provide a combination of illuminating effects such as identification means for the edifice upon which the systems were mounted as well as light to provide security. This had the effect of increasing the cost to the operator in that several light fixture systems had to be utilized to accomodate this combination of effects.

SUMMARY OF THE INVENTION

A light fixture system which includes a housing adapted to be mounted to an external wall of an edifice. The housing includes at least a pair of openings formed through a frontal portion of the housing. A lamp is contained within the housing for emitting light through each of the openings. A first window member is mounted on a frontal portion of the housing and is translucent and further covers one of the housing openings. Additionally, a second window member which is substantially transparent covers the other of the housing openings.

An object of the present invention is to provide an inexpensive lighting system used for security purposes.

Another object of the instant invention is to provide a fluorscent or generally gas vapor lamp contained within a light fixture housing to provide an inexpensive light transmitting mechanism for use external to an edifice.

A still further object of the instant invention is to provide a light fixture system which has the purpose of both providing security lighted areas as well as an identifying means for the edifice to which it is mounted.

A still further object of the instant invention is to provide a light fixture system having a housing which is contoured in a particular manner such that the internal section of the housing is water proofed.

Anoter object of the instant invention is to provide a light fixture system which is inexpensive to manufacture and of low cost to operate.

BRIEF DESCRIPTION OF THE DRAWINGS

FIG. 1 is an elevational view of the light fixture system mounted to an external wall of an edifice;

FIG. 2 is a cross sectional view of the light fixture system taken along the section lines 2—2 of FIG. 1; and, FIG. 3 is a sectional view of the light fixture system taken along the sectional lines 3—3 of FIG. 2.

DESCRIPTION OF THE PREFERRED EMBODIMENTS

Referring now to FIGS. 1–3 there is shown light fixture system 10 adapted to be mounted to external wall 12 of edifice 14. In general, light fixture 10 may be fastened external to edifice 14 on any wall member or surface which may accomodate it. In particular, system 10 may be dimensionally sized in order that such may be secured above door way 16 of a residential dwelling as well as a commercial establishment in order to optimize the use of system 10 for identification as well as security purposes. Although light fixture system 10 is shown for illustration, mounted above doorway 16, it is to be understood that system 10 may be secured to external wall 12 at any location desired by the user. As will be detailed in following paragraphs, light fixture system 10 may optimally be used to provide numerical identification of edifice 14 in combination with sufficient lighting for security purposes as well as providing structure for a name plate member having additional indicia printed thereon. In overall concept, light fixture system 10 provides an operatively inexpensive light emitting fixture which combines the use of such for both security and identification purposes.

Referring now to FIGS. 2 and 3, light fixture system 10 includes housing 18 which is adapted to be mounted to edifice external wall 12 though contiguous interface of flange members 22 formed on opposing lateral side walls of housing 18. The mounting or secured fastening of system 10 to wall 12 provided by bolts 20 or some like structural mechanism which provides for secured fastening and which are well known in the art. Housing 18 includes housing rear wall 24 which is generally planar in construction and extends in a generally vertical direction as shown in FIG. 2 in order to contiguously contact and be easily secured to external wall 12. Rear wall 24 of housing 18 designates the rear portion or section of housing 18 and may be connected in one piece formation to upper wall 26 as is shown clearly in FIG. 2.

Upper wall member 26 forms acute angle 28 between the plane of upper wall 26 and the plane of vertically extending rear wall 24 of housing 18. Upper wall 26 passes in a generally declining linear manner from the rear portion thereof. The linear declination of upper wall member 26 may be important in that acute angle 28 defines and provides for a constrained path of rain water or other liquid impinging on upper wall member 26. Due to the geometric contour of wall 26, the impinging liquid is directed over a front portion of housing 18 and has a flow path of least resistance external to housing 18. Additionally, it will be noted as shown in FIG. 2, that waterproofing of housing 18 is aided when upper wall 26 and housing rear wall 24 are formed in one piece construction. This has the effect of reducing mechanical interfaces and thus clearances where liquid impinging from above housing 18 may be given some flow path internal to housing 18.

First front wall 30 positionally located in a generally vertical plane in the frontal portion of housing 18 includes opening 32 to provide a light path external to housing 18 as will be described in following paragraphs. Opening 32 may have a rectangular, circular, elliptical, or other contour with the only restriction being that it be of sufficient size and area such that appropriate indicia 34 inscribed thereon may be seen. In general, first frontal wall 30 is connected to upper wall member 26 in one piece fashion in order to aid in the water proofing of housing 18 as has been previously described for the connection between upper wall member 26 and housing rear wall 24.

First window member 36 is adapted to be connected to first frontal wall 30 and covers opening 32 as is shown in FIG. 2. Window member 36 is substantially planar in contour and forms a translucent cover plate for opening 32 of housing 18. Window member 36 is mounted internal to housing 18 by a pair of L-shaped brackets 38 or some like releasable securing mechanism which are in themselves mounted to an internal surface of first frontal wall 30. The internal mounting of window member 36 also aids in the waterproofing of housing 18 in that the passage of liquid-being directed to a frontal portion of housing 18 from upper wall member 26 would generally pass external to the outer boundary surfaces of housing 18. This type of positional securement reduces mechanical or structural. interfaces in the passage of liquid over housing 18.

First window member 36 passing in a substantially vertical plane is composed of a translucent material for diffusing light therethrough. In one form of the invention, window member 36 may be composed of a white milk glass of some translucent plastic type material well known in the art. Indicia 34 representing the identification of edifice 14 may be printed in script or other type identifying print in a manner such that indicia 34 would generally be opaque to the passage of light from internal to housing 18, thus, allowing an observer to easily identify edifice 14.

Second frontal wall 40 passses from a rear portion of housing 18 to a frontal section thereof and is releasably connected to first frontal wall 30 through screws 44 or some other like releasable fastening means. Second frontal wall 40 includes opening 46 passing therethrough to provide transmission of light originating internal to housing 18. Through opening 46 may have a variety of contours such as rectangular, elliptical, or some like contour with the only restriction being that such opening 46 provides sufficient light passage for security or identifying purposes.

Second window member 42 is substantially transparent and is adapted to cover opening 46 as is shown. Window 42 may be composed of a transparent glass, clear plastic, plexiglass, or some like material which has a high index of light transmission. As has hereinbefore been described for first window member 36, second window member 42 is mounted internal to housing 18 through a set of L-shaped brackets 48 or some like mechanism which would permit releasable securement of window member 42 to frontal wall 40. Second frontal wall 40 and associated window member 42 are seen to form a substantially planar contour defining acute angle 50 between the combination of frontal wall 40 and window member 42 and substantially vertically directed housing rear wall 24.

Acute angle 50 thus defines the graphical displacement of wall 40 in a generally inclining linear manner from the rear portion of housing 18 to the frontal portion where wall 40 is mechanically connected to frontal wall 30 through thumb screws 44 or some like mechanism. Wall 40 is thus positionally located below first front wall 30 and inclined in an upward direction to provide a larger area of light transmittal external to housing 18 than would be the case if angle 50 were increased to a right angle or beyond. Additionally, the positional location and contour of window member 42 in combination with frontal wall 40 adds to the substantial waterproofing of the internal portions of housing 18. Liquid passing either from upper wall member 26 or from first frontal wall 30 would have a gravity force causing it to be passed vertically downward instead of internal to housing 18. Thus, the contour and displacement of frontal wall 40 further defines an obtuse angle 52 between opposing window members 42 and 36 which aids in providing interior chamber 54 of housing 18 substantially independent of external conditions.

Second frontal wall 40 is connected to rear housing wall 24 through hinge member 56 where opposing hinge flange sections 58 and 60 are connection through mechanical securement to rear wall 24 and second frontal wall 40 respectively. This mechanical attachment may be through screws, bolts, adhesives, or some similar like techniques well known in the art. Thus removal of thumb screws 44 connecting frontal walls 40 and 30 permits rotative displacement of front wall 40 with respect to rear wall 24 of housing 18 to allow access to interior chamber 54 of housing 18.

Lamp 62 within chamber 54 of housing 18 emits light through each of openings 32 and 46 as well as window members 42 and 36. Lamp 62 may be a fluorescent bulb having ballast 64 connected through leads 66 to an appropriate electrical outlet for providing the electrical energy necessary for the transmittal of the light. Where lamp 62 is a fluorescent light bulb it is mounted within fluorescent receptacles 68 in a manner well known in the art. In general, lamp 62 may be a gas vapor light as well as a flourescent type lighting fixture. Use of either a gas vapor light or fluorescent generally provides for inexpensive light transmittal when compared with the flood lights utilized in common practice.

Reflector 70 is mounted to and passes contiguously with respect to rear wall 24 as is shown. Reflector 70 may be secured to wall 24 through adhesive mechanisms, bonding, screws, bolts, or some like technique. Reflector 70 includes a curvilinear portion 72 which passes around at least a portion of lamp 62 in order to reflect and optimize light transmittal through first and second window members 36 and 42. As is seen, curvilinear portion 72 is displaced from but generally passes in a similar contour to the periphery of lamp 62 in order to provide the necessary directed light transmittal. The surface of reflector 70 is generally either highly polished or includes a white paint coating in order to optimize the reflector properties of member 70.

Rear wall 24 includes extended lower wall section 74 passing in a substantially vertical planar direction below second window member 42. Lower wall section 74 is positionally located beneath and to the rear of window 42 in order that it be easily illuminated by lamp 62 within housing chamber 54. Lower wall section 74 may have indicia 76 printed thereon for purposes of identifications as is shown in FIG. 1, and may serve as a nameplate.

Although not of critical importance to the inventive concept as has herein been described, light system 10 generally includes a lateral extension sufficient to pass throughout the width of either doorway 16 or windows 78 when it is desired to mount system 10 above windows 78.

Although this invention has been described in connection with specific forms and embodiments thereof, it will be appreciated that various modifications other than those discussed above may be resorted to without departing from the spirit or scope of the invention. For example, equivalent elemental structures may be substituted for those specifically shown and described, certain features may be used independently of other features, and in some cases, parts may be reversed, all without departing from the spirit or scope of the invention as defined in the appended claims.

What is claimed is:

1. A light fixture system comprising:

a. a housing having mounted means for mounting to an external wall of an edifice, said housing including at least a pair of openings formed through a frontal portion of said housing;

b. lamp means within said housing for emitting light through each of said openings;

c. a first frontally directed window member being translucent and having indicia formed thereon and covering one of said housing openings, said first window member being releasably mounted to said frontal portion internal said housing; and, d. a second substantially downwardly directed window member being substantially transparent and covering the other of said housing openings, said second window member being releasably mounted to said frontal portion internal said housing, said housing having a rear wall section passing in a substantially vertical planar direction below said second window member being adapted to have indicia formed thereon.

2. The light fixture system as recited in claim 1 wherein said first window member is substantially planar in contour and forms a translucent cover plate for one of said openings of said housing.

3. The light fixture system as recited in claim 2 where said first window member is maintained in alignment with said housing opening by a pair of L-shaped brackets secured to an inner surface of said frontal wall of said housing.

4. The light fixture system as recited in claim 2 where said first window member mounted to said housing passes in a substantially vertical plane.

5. The light fixture system as recited in claim 2 where said first window member is composed of a translucent material for diffusing light passing therethrough.

6. The light fixture system as recited in claim 5 where said first window member is composed of a translucent plastic material.

7. The light fixture system as recited in claim 5 where said first window member includes indicia formed between for identification purposes.

8. The light fixture system as recited in claim 1 where said second window member is substantially planar in contour and forms a substantially transparent cover plate for a respective opening formed within said housing.

9. The light fixture system as recited in claim 1 where said second window member is mounted internal said housing to a second frontal wall of said housing, said second frontal wall and said second window member forming a substantially planar contour defining an acute angle between said frontal wall and said second window member planar contour and a rear wall of said housing.

10. The light fixture system as recited in claim 9 where said second frontal wall of said housing is positionally located below a first frontal wall of said housing containing said first window member.

11. The light fixture system as recited in claim 10 where said second frontal wall of said housing forms an obtuse angle with respect to a planar contour of said first frontal wall of said housing.

12. The light fixture system as recited in claim 10 including hinge means secured to said rear wall of said housing and said second frontal wall for providing rotative displacement of said second frontal wall with respect to said rear wall.

13. The light fixture system as recited in claim 12 where said second frontal wall is releasably secured to said first frontal wall of said housing.

14. The light fixture system as recited in claim 1 where said housing includes an upper wall member forming an acute angle between said upper wall and a vertically extending rear wall of said housing, said upper wall passing in a declining linear manner from a rear section of said housing to said frontal portion of said housing.

15. The light fixture system as recited in claim 1 including reflector means mounted to a rear wall of said housing, said reflector means passing around at least a portion of said lamp means for optimizing light transmittal through said first and second window members.

16. The light fixture system as recited in claim 15 where said reflector means is contoured in a shape similar to to said lamp means throughout a section of said reflector means passing around said lamp means.

17. The light fixture system as recited in claim 1 where said lamp means is a fluorescent lamp.

18. The light fixture system as recited in claim 1 where said lamp means is a gas vapor lamp.

* * * * *